US006719209B1

(12) United States Patent
Pergay et al.

(10) Patent No.: US 6,719,209 B1
(45) Date of Patent: Apr. 13, 2004

(54) MULTIPURPOSE SPRAY HEAD USEFUL IN PARTICULAR FOR MAKING ARTIFICIAL SNOW

(75) Inventors: Bernard Pergay, Franchville (FR); Patrick Charriau, Rocheserviere (FR); Michel Galvin, Carquefou (FR)

(73) Assignee: York Neige, Ste.-Luce sur Loire (FR)

( * ) Notice: Subject to any disclaimer, the term of this patent is extended or adjusted under 35 U.S.C. 154(b) by 0 days.

(21) Appl. No.: 09/830,178

(22) PCT Filed: Oct. 22, 1999

(86) PCT No.: PCT/FR99/02581

§ 371 (c)(1),
(2), (4) Date: Jun. 13, 2001

(87) PCT Pub. No.: WO00/25072

PCT Pub. Date: May 4, 2000

(30) Foreign Application Priority Data

Oct. 23, 1998 (FR) ..... 98 13477
Feb. 5, 1999 (WO) ..... PCT/FR99/00258

(51) Int. Cl.[7] ..... F25C 3/04

(52) U.S. Cl. ..... 239/14.2; 239/550; 239/553.5; 239/567

(58) Field of Search ..... 239/14.2, 2.2, 239/567, 550, 553, 553.3, 553.5

(56) References Cited

U.S. PATENT DOCUMENTS

| | | | | | |
|---|---|---|---|---|---|
| 1,084,842 | A | * | 1/1914 | Bustin | 239/533 |
| 3,334,820 | A | * | 8/1967 | Flynn | 239/533.3 |
| 3,829,013 | A | | 8/1974 | Ratnik | |
| 3,964,682 | A | * | 6/1976 | Tropeano | 239/14.2 |
| 4,004,732 | A | * | 1/1977 | Hanson | 239/14.2 |
| 4,270,612 | A | * | 6/1981 | Larsson | 239/533 |
| 5,004,151 | A | | 4/1991 | Dupre | |
| 5,979,785 | A | * | 11/1999 | McKinney | 239/14.2 |

FOREIGN PATENT DOCUMENTS

| | | |
|---|---|---|
| WO | WO 97/16686 | 5/1997 |
| WO | WO 97/18421 | 5/1997 |

* cited by examiner

*Primary Examiner*—Dinh Q. Nguyen
(74) *Attorney, Agent, or Firm*—Young & Thompson

(57) ABSTRACT

A spray head includes a sleeve provided with sprayers and divided into several chambers by a core element with several internal partitions. Each chamber is fed by passages and the main chamber is fed by a passage which passes through the cap, the cap including at least a spraying device in the form of a mini snow gun operating as nucleator.

12 Claims, 3 Drawing Sheets

MULTIPURPOSE SPRAY HEAD USEFUL IN PARTICULAR FOR MAKING ARTIFICIAL SNOW

BACKGROUND OF THE INVENTION

This invention concerns a spray head useful in particular for making snow.

DESCRIPTION OF THE RELATED ART

This spray head is more especially intended for an installation such as described in the document FR-2 743 872.

For this type of installation, it, is interesting to be able to have a spray head that suits easily all the loads associated with its use such as, for example, the loads linked with the climatic conditions of the installation site.

SUMMARY OF THE INVENTION

This invention suggests a multipurpose spray head that comprises means enabling the said head to make quantities of artificial snow, suited to the variations of climatic conditions.

The spray head according to the invention comprises at least two nozzles fed separately by pressurised water systems, whereas these nozzles are arranged radially on the periphery of a tubular sleeve whose axis is close to the vertical in normal operating conditions, which sleeve holds a core element that is fitted with radial partitions in order to divide in a watertight fashion, the internal space of the said sleeve into several chambers, a main chamber and at least one secondary chamber that is implemented after the main chamber if necessary, which chambers are used for feeding one or several nozzles, which core element is fitted with internal passages connected to the said pressurised water systems in order to feed each chamber.

Still according to the invention, the upper portion of the spray head comprises a cap fitted with at least one spraying device operating as a nucleator and arranged beside or in the field of the nozzle(s) of the main chamber, which device, in the form of a cartridge, is fed with pressurised water and air, which supply runs, as regards water, through the feeding passage of the said main chamber, which passage transits through the said cap, and the air is supplied via a specific passage provided in the core element and in the cap, in their respective centres.

According to another embodiment of the invention, the inlet orifice(s) for the pressurised water of the nucleation device are situated in a zone of the cap of the spray head, which is arranged in order to enable permanent circulation of the pressurised water around the said orifices in order, on top of the supply of the said orifices, to avoid freezing phenomena at the level of the said orifices.

According to another arrangement of the invention, still with a view to avoiding freezing phenomena at the head, the different feeding passages of the chambers of the said head emerge into the lower portion of each chamber, thus enabling total purge of the said chambers once the installation has stopped. In case when the passage of the main chamber transits through the cap, the said passage comprises in its return leg, extending from the said cap to the said main chamber, a purge passage extending between the lower extremity of the said chamber and the arrival passage provided in the core element.

According to a variation of the invention, the nucleation device, still in the form of a cartridge, is integrated radially in the spray head, going through the tubular sleeve and it is shrink-fitted into the central core of the said head up to the arrival passage of the pressurised air, which device is water fed directly via the main chamber of the said head, in which its pressurised water inlet orifices are situated.

According to a variation, the nucleation device comprises a cartridge making up the mixing chamber and two nozzles for spraying the air-water mixture, whereas each nozzle is oriented parallel to the faces of the dihedrals in which are for instance aligned the nozzles for spraying pressurised water.

In the various cases above, the body of the nucleation device is immersed in the water circulating in the main chamber, to avoid freezing and clogging the small orifice(s) due to permanent circulation of water inside the said chamber.

According to the invention, the spray head comprises a foot that is arranged in order to be fixed on a pole, which pole comprises for example several ducts for feeding pressurised water and possibly pressurised air, which ducts are arranged in relation to orifices arranged in the said foot in order to feed the different nozzles of the said head.

BRIEF DESCRIPTION OF THE DRAWINGS

The invention will be detailed further using the following description and the appended drawings, given for exemplification purposes, and in which.

DESCRIPTION OF THE PREFERRED EMBODIMENT

Figure 1:
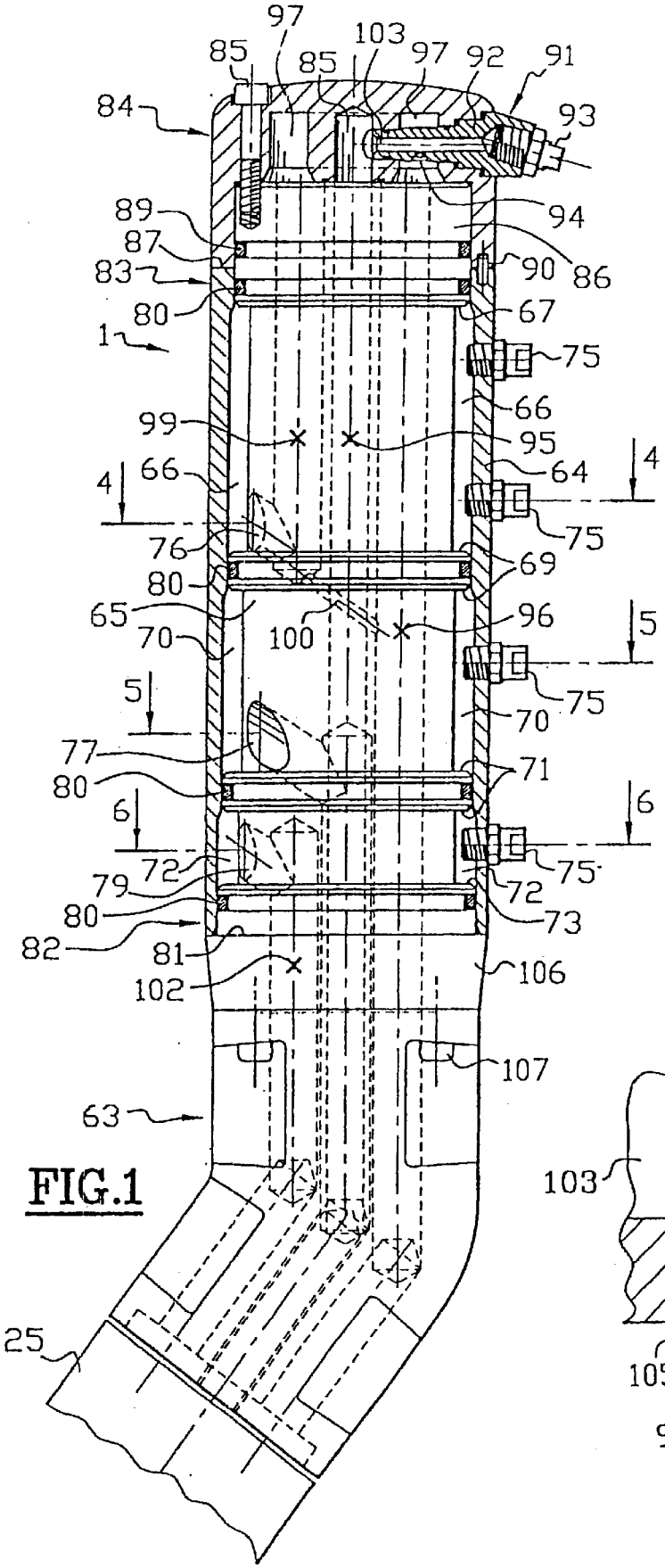
FIG. 1 represents a spray head according to the invention in axial vertical cross sectional view.

The spray head represented on FIG. 1 is more particularly intended for installation at the extremity of a pole as in the case of the installation described in the patent mentioned previously FR-2 743 872 of the applicant.

Between the spray head 1 properly speaking and the upper extremity of the mast 2, a part 63 may operate as a go-between, as represented on FIG. 1. This part 63 is slightly bent to give the head 1 a favourable tilt, close to the vertical, or slightly tilted to cause water spray at an angle that promotes projection onto the longest possible distance in relation to the needs and to the site.

The spray head is composed of a tubular sleeve 64 and of a cylindrical core 65 centred in the said sleeve, and whose diameter is smaller than that of the said sleeve to enable passage of the pressurised water. The core element 65 comprises circular radial partitions that divide the internal space between the sleeve 64 and the said core element, into several chambers.

Thus we find the following items:—a main chamber 66, at the upper portion of the spray head, delineated by the partitions 67 and 69 of the core element 65,—an intermediate chamber 70 delineated by the partitions 69 and 71 and a lower chamber 72 delineated by the partitions 71 and 73. The partition 73 is situated at the lower portion of the core element 65 and the partition 67 at the upper portion.

Every chamber feeds one or several jets 75 implanted on one or several generatrices of the cylindrical shell of the sleeve 64.

The chamber 66 that makes up the main chamber, may comprise several jets 75 distributed over several generatrices.

The nozzles 75 of the chambers 70 and 72 are complementary nozzles that are implemented independently of those of the chamber 66, in relation to the climatic conditions in order to increase the quantities of snow produced, according to these climatic conditions.

Every chamber is fed by a passage emerging into the former at its lower portion.

FIG. 1 shows the orifice 76 emerging into the chamber 66 at its lower portion, i.e. at the partition 69 of the core element 65. An orifice 77 emerges into the lower portion of the chamber 70 at the partition 71, and an orifice 79 emerges into the chamber 72 at the partition 73.

Tightness between the sleeve 64 and the different partitions 67, 69, 71 and 73, is realised by means of O-rings 80 arranged in the thickness of the said partitions.

The lower portion of the core element 65 comprises a seat 81 in the form a radial shoulder, on which rests the lower extremity 82 of the core element 64. The core element 65 extends above the upper extremity 83 of the sleeve 64 and it is covered by a cap 84 that is fixed by screws 85 placed in the upper cylindrical extremity 86 of the core element 65. The joint plane 87 between the sleeve 64 and the cap 84 is situated between the O-ring 80 of the partition 67 and an O-ring 89 arranged in a groove provided in the upper cylindrical extremity 86 of the core element 65.

The cap 84 is positioned with respect to the core element 65 accurately either by a unique distribution of the screws 85 and/or a centring pin 90.

This position of the cap 84 enables to place the sleeve 64 in an accurate position also using the centring pin 90 interposed between both at the joint plane 87.

The cap 84 comprises at least one nucleation device 91 that operates as a nucleator, to manufacture ice or snow particles that will then seed the different jets from the nozzles 75 of the spray head. This nucleation device 91 comprises a cylindrical body in the form of a cartridge 92 inserted radially into an orifice provided to that effect in the cap 84, and a nozzle or jet 93 that is preferably oriented toward the jets of the different nozzles 75 for better seeding.

The cartridge 92 of the nucleation device is fixed by any appropriate means in the cap 84, with screws for instance; it will be detailed below.

The nozzles 75 are fed with pressurised water from passages supplying the pressurised water to the different chambers. The distribution of these passages in the core element 65 appears on the different cross sectional views represented on FIGS. 4 to 6 and, as a dotted line on FIG. 1.

The nucleation device 91 making up a kind of high pressure mini snow gun with very high air/water ratio, at least equal to 200, is fed with pressurised water using one of the feeding passages of the chambers and in particular using the passage feeding the main chamber 66.

This mini gun is also fed with pressurised air. FIGS. 4 to 6 and FIG. 1 show a passage 95 provided in the centre of the core element 65, reaching into the cap 84, in the form of a central blind hole. This passage 95 enables to bring the pressurised air up to the level of the nucleation device 91 and in particular at the downstream inlet of the mixing chamber of the said device, detailed below.

The chamber 66 is arranged just beneath the nucleation device 91; it is fed with pressurised water via a passage 96 also reaching into the cap 84, which cap comprises an annular cavity 97 which is traversed by the cartridge 92 of the nucleation device 91. Thus, the passage 96 extends over the whole length of the core element 65; it communicates with the annular cavity 97 provided in the cap 84 and a second passage 99 provided in the core element 65 extends from the said cavity 97 of the cap 84, up to the lower section of the chamber 66, emerging at the orifice 76 into the said chamber in order to feed the latter.

Figure 4:
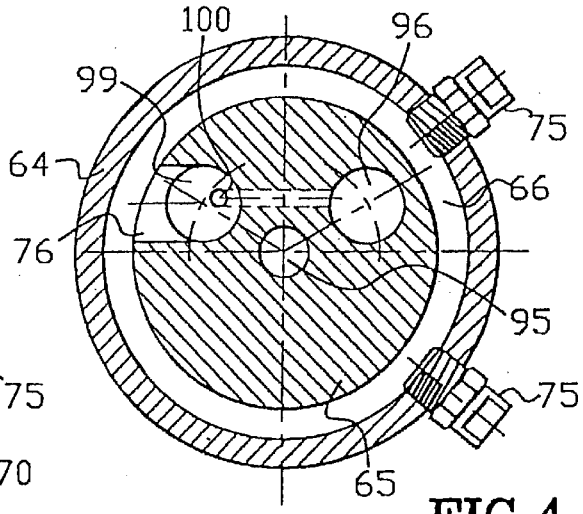
FIG. 4 represents the head as a cross sectional view along 4—4 of FIG. 1.

FIGS. 1 and 4 show that the chamber 66 feeds several nozzles 75, arranged in pairs on two different generatrices. These nozzles 75 are aligned vertically with the nozzles arranged at the other chambers 70 and 72 and also with the nucleation devices 91.

As indicated previously, the orifice 76 is situated at the lower portion of the chamber 66. We note, in the extension of this orifice 76, a small passage 100 with reduced diameter, extending between the passage 99 and the passage 96, arranged in such a way that it enables total purge of the water situated in the chamber 66, when the water supply is turned off.

The diameter of this passage 100 is in the order of $1/5^{th}$ of the diameter of the passages 96 and 99 in order to maintain preferential circulation of the pressurised water, in the cavity 97 of the cap 84.

Figure 5:
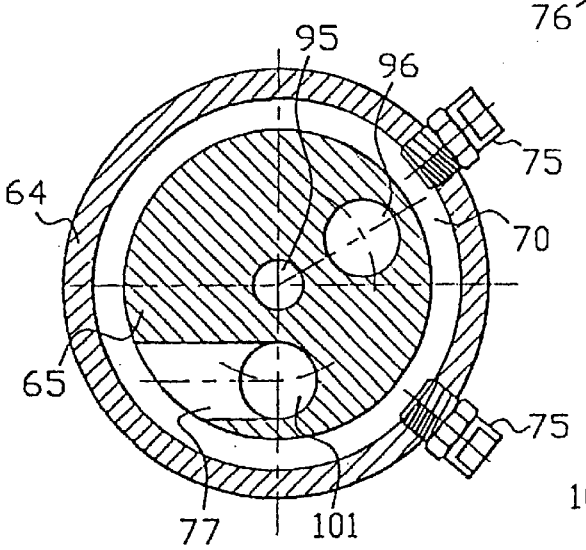
FIG. 5 represents the head as a cross sectional view along 5—5 of FIG. 1.

FIG. 5 shows a cross sectional view at the orifice 77 that enables to feed the chamber 70 and the nozzles 75. This orifice 77 is fed via a passage 101 extending axially in the core element 65.

FIG. 5 also shows the passage 95 arranged in the centre of the core element in which the compressed air circulates and the passage 96 used for feeding the chamber 66 and at the same time for feeding the nucleation devices 91 while ensuring around these nucleation devices constant water circulation that enables to avoid the frost phenomenon.

Figure 6:
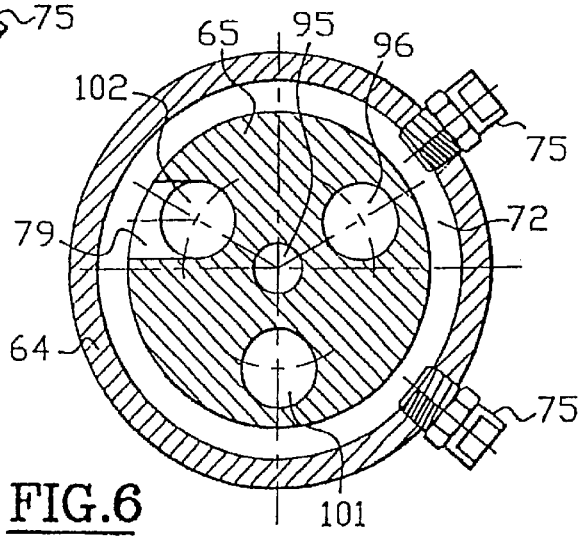
FIG. 6 represents the head as a cross sectional view along 6—6 of FIG. 1.

FIG. 6 corresponds to a cross sectional view at the orifice 79 used for feeding the chamber 72 and the lower nozzles 75. This chamber 72 is fed via a passage 102 extending parallel to the passage 101, the passage 96 and the central passage 95 used for letting compressed air through.

We note that the passage 102 is situated beneath the passage 99, centred almost on the same axis. The lower extremity of the passage 99 and the upper extremity of the passage 102 are separated by a distance that corresponds substantially to the height of the chamber 70.

Figure 2:
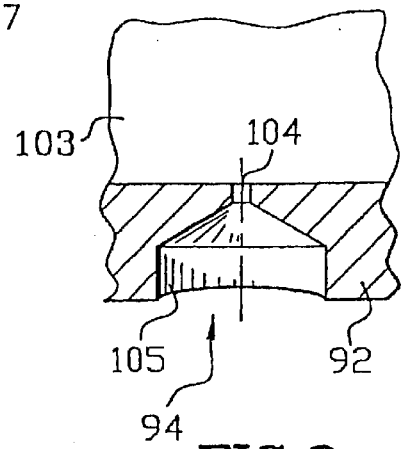
FIG. 2 represents in a detailed and enlarged fashion, an orifice for feeding pressurised water into the mixing chamber of the nucleation device.

FIG. 2 shows the detail of one of the orifices for injecting pressurised water into the cartridge 92 of the nucleation device 91.

This cartridge 92, tubular in shape, comprises in its central portion an axial chamber 103 emerging downstream on the nozzle 93 side and that is open upstream on the passage 95 in the cap 84.

The diameter of the axial mixing chamber 103 is substantially greater than the diameter of the outlet nozzle 93. Pressurised water used for feeding the main chamber 66 is fed radially into the mixing chamber 103 via orifices 94, preferably three orifices distributed on the periphery of the cartridge 92, whose jets can be concurring on the axis of the said mixing chamber.

These orifices 94, one of which is represented as an enlarged cross sectional view on FIG. 2, are situated roughly toward the upper portion of the mixing chamber 103.

As represented on FIG. 2, the external wall of the cartridge 92 is drilled radially with a first hole 104 whose diameter is smaller than 1 mm, and a second hole or countersink 105 with much greater diameter. The diameter of the hole 105 is in the order of ten times the diameter of the hole 104. The length of the hole 104 is in the same order as its diameter. Thus, pressurised water is injected into the mixing chamber 103 while passing through a kind of diaphragm that also enables the nucleation device 91 to operate whatever the pressure of the water injected into the main chamber 66 for feeding the nozzles 75.

For exemplification purposes, the nucleation device can exhibit the following features: for an outlet at the nozzle 93 in the order of 5.2 mm, a diameter will be selected for the mixing chamber 103 in the order of 7 mm and each of three orifices 104 will have a diameter in the order of 0.6 mm.

The operation of this nucleation device 91 is similar to a high pressure type mini snow gun, in which the air/water ratio is quite significant, at least equal to 200 and preferably much higher.

The spray head 1 and in particular the seat 106 of the core element 65 is fixed using screws 107 on the intermediate fitting 63, which fitting 63 is fixed itself using screws, not represented, on the extremity of the mast 25.

Figure 3:
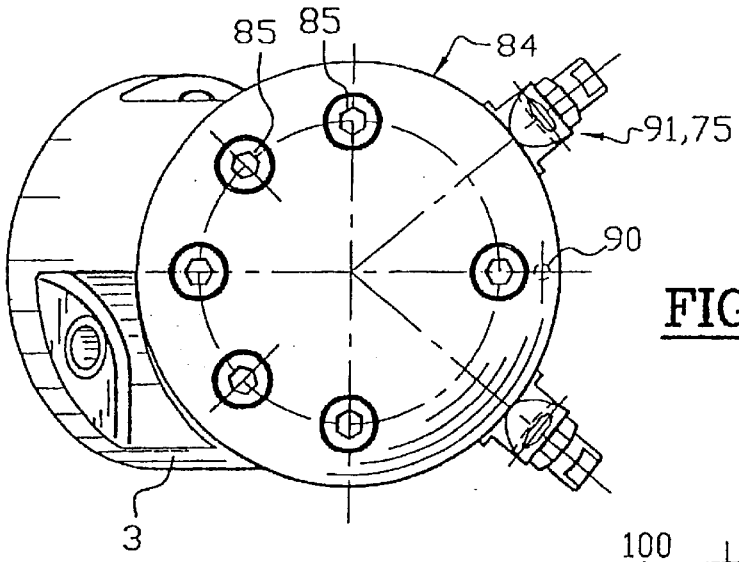
FIG. 3 represents a top view of the spray head.

FIG. 3 shows the distribution of the screws 85 that enable to fasten the cap 84 to the upper extremity of the core element 65. The distribution of the screws is such, as indicated previously, that it imposes accurate orientation of the head with respect to the core element 65 and consequently, an orientation also defined for the sleeve 64 that carries the nozzles 75, using the centring pin 90 interposed between the said sleeve and the said core element.

Figure 7:
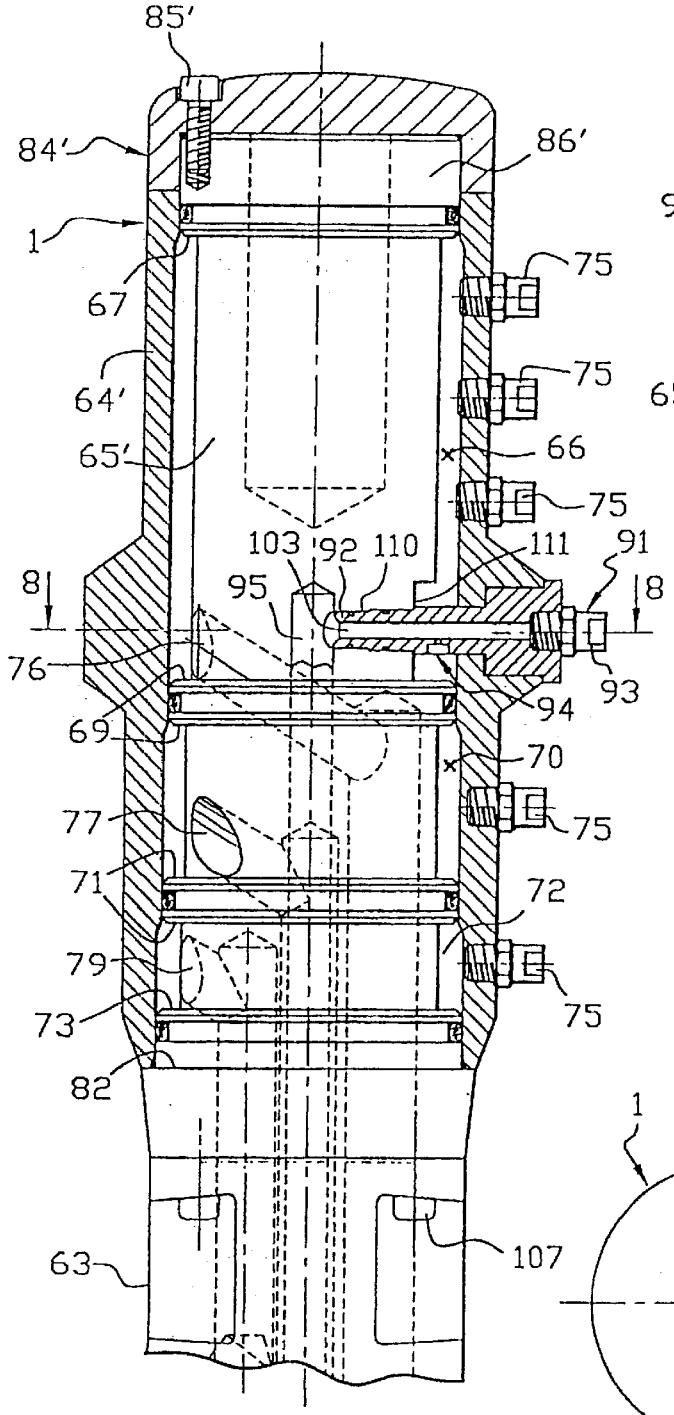
FIG. 7 represents a variation of the spray head represented on FIG. 1, as an axial vertical cross sectional view.

FIG. 7 represents a variation of the spray head represented on FIG. 1.

This variation repeats the arrangement of the chambers 66, 70 and 72. Still, the implantation of the nucleation device(s) 91 constitutes a simplification. The nucleation device is indeed integrated directly at the lower portion of the chamber 66.

FIG. 7 also shows a portion of the intermediate part 63 to which the core element 65' is fixed. The core element 65' is in the form of a moulded and machined part, made of light alloy, and looks like a kind of hydraulic slide valve inserted into a shell 64'. This shell 64' is itself made of a machined moulded part, of light alloy, maintained between the lower shoulder 81 of the core element and the cap 84' that is fixed by screws 85' to the upper extremity 86' of the core element 85'.

The chambers 66, 70 and 72 are, as previously, arranged between partitions. Thus, we find the upper partition 67 that delineates the annular chamber 66, with the partition 69.

The annular chamber 70 is delineated by the partition 69 and the partition 71. This partition 71 is interposed between the chamber 70 and the chamber 72, which annular chamber 72 is delineated at its lower portion by the partition or shoulder 73.

To facilitate the assembly, the partitions can have diameters increasing gradually from the extremity of the core element up to its seat 81.

These chambers are fed as previously for the head represented on FIG. 1, by ducts illustrated as a thin dotted line, emerging via a radial drilling into the lower portion of each of the said chambers. These radial drillings are also tilted to enable efficient and complete purge of each of the chambers to avoid frost once the spraying has stopped.

Thus, there is still the orifice 76 that enables to inject pressurised water in the chamber 66. This injection into the chamber 66 is performed directly at the lower portion without going through, as previously, FIG. 1, by the cap 84.

The chamber 70 is fed through the orifice 77 and the chamber 72 is fed through the orifice 79.

A central passage 95, in the core element 65', enables to inject the pressurised air into the nucleation device 91. This nucleation device has, as shown previously on FIG. 1, the form of a cartridge 92. This cartridge 92 goes through the wall of the shell 64', in a watertight fashion, and it is for example screwed to that wall; it is shrink-fitted into an orifice 110 arranged radially in the core element 65', which orifice emerges into the passage 95 supplying the pressurised air.

Thus, the nucleation device is fed with pressurised air at the upstream extremity of its mixing chamber 103, and the pressurised water is fed via one or several orifices 94 provided in the wall of the cartridge 92.

These orifices 94 are situated in the chamber 66, fed directly with pressurised water at the same time as the spray nozzles 75.

The cartridge 92 of the nucleation device 91 is immersed in the water circulating in the chamber 66 to avoid freezing and clogging the holes that enable injection of water into the mixing chamber 103.

Figure 8:
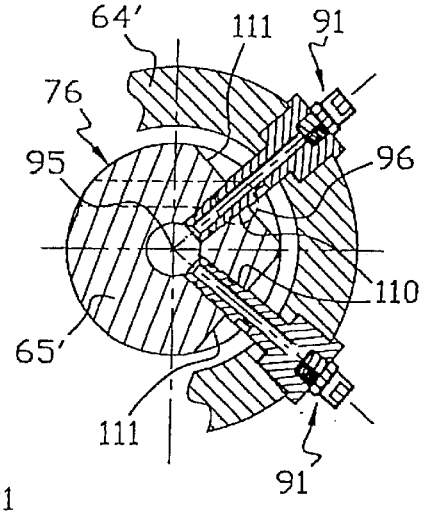
FIG. 8 represents a cross sectional view along 8—8 of FIG. 7.

As represented on FIG. 8, the core element 65' and the tubular sleeve 64' can be arranged in order to position nucleation devices 91, describing an angle close to 90° in relation to one another. These nucleation devices are arranged at the lower portion of the main chamber 66, each beneath a vertical row of spray nozzles 75, which nozzles are represented as three in number on FIG. 7, along a same line and in the same vertical plane.

The vertical plane containing a nucleator 91 and the nozzles 75 of the main chamber 66, also comprises the spray nozzles 75 associated with the chambers 70 and 72 situated beneath the main chamber 66.

It should also be noted that the cartridge 92 of the nucleation device(s) 91 is used for positioning the chamber 64' of the spray head at an angle with respect to the core element 65' since it is shrink-fitted radially in the said sleeve and the said core element.

The nozzle 93 of the nucleation device 91 is oriented like all the other nozzles 75, perpendicular to the longitudinal axis 109 of the head 1. It is arranged beneath the nozzles 75 of the main chamber 66 and not above, as in the case of the head represented on FIG. 1.

FIGS. 7 and 8 show that the core element comprises a countersink 111 at each orifice 100 in which the cartridge 92 of the nucleation devices 91 is shrink-fitted.

These countersinks enable to obtain good circulation of water around the cartridge 92 of the nucleation devices 91 and to offer sufficient space to accommodate the orifices 94 of the cartridges 92, at which pressurised water enters the said cartridge and in particular the mixing chamber 103.

The orifices 94 of the nucleation devices represented on FIG. 7 correspond to the orifices 94 represented on FIG. 2 in connection with FIG. 1.

Figure 9:
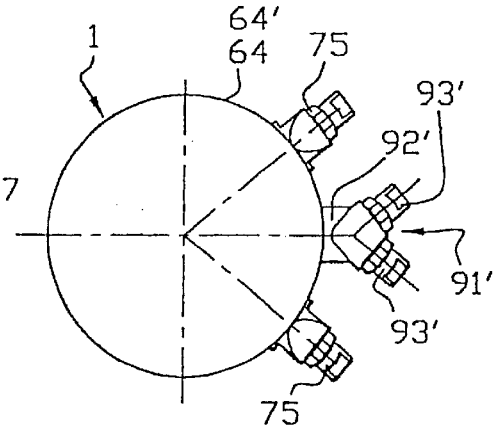
FIG. 9 represents a variation of a two nozzle nucleation device, common to two rows of spray nozzles.

FIG. 9 shows an embodiment variation of the nucleation device assembly on the spray heads in the form of columns represented on FIGS. 1 and 7.

The nucleation device 91' comprises a cartridge 92' that is fitted with two nozzles or jets 93'. The cartridge is centred on the median plane of the dihedral formed by both rows of spray nozzles 75 whereas the nozzles 93' are oriented parallel and respectively at each face of the said dihedral.

This particular arrangement enables to realise seeding with a single nucleator, which nucleator comprises, in such a case, orifices 94 in the cartridge 92', for water injection, which are substantially greater than those of the previous assemblies. Thus, the risks of freezing the orifice(s) 104, in particular, are reduced even more.

What is claimed is:

1. A snow-making spray head comprising:

a tubular sleeve, a plurality of nozzles arranged radially on a periphery of said tubular sleeve, a core element disposed in said sleeve, said core element having radial partitions that divide the interior of said tubular sleeve in watertight fashion into a plurality of chambers, said nozzles communicating separately with said chambers, said core element having internal passages that feed water under pressure to said chambers, said chambers being supplied independently in relation to climatic conditions in order to increase quantities of snow produced.

2. The spray head as claimed in claim 1, adapted to occupy an upright position, said passages emerging into a lower portion of said chambers when said spray head is in said upright position, thus allowing total purge of the chambers once the supply of water to said chambers has stopped.

3. The spray head as claimed in claim 1, having a distal end which comprises a cap having at least one spraying device operating as a nucleator, means to supply pressurized water and air to said spraying device, said spraying device directing pressurized water and air into an area in which said nozzles discharge water.

4. The spray head as claimed in claim 3, wherein said nozzles are arranged in a row and discharge water in a common plane, and said spraying device discharges air and water under pressure in said plane.

5. The spray head as claimed in claim 3, wherein said nozzles are arranged in plural rows discharging water in divergent planes, and said spraying device discharges air and water under pressure between said divergent planes.

6. The spray head of claim 1, wherein, said core element disposed in said sleeve is a cylindrical core centered in said sleeve and having a longitudinal length, said partitions are mounted to an outer cylindrical surface of said core element, said cylindrical core comprising plural pressurized water passages running the longitudinal length of said cylindrical core and internally to said cylindrical core, said internal passages that feed water under pressure to said chambers branch radially from said water passages.

7. The spray nozzle of claim 6, further comprising a pressurized air passage running the longitudinal length of said cylindrical core and internally to said cylindrical core.

8. The spray nozzle of claim 1, wherein, said core element disposed in said sleeve is a cylindrical core centered in said sleeve and having a longitudinal length, said partitions are mounted to an outer cylindrical surface of said core element, and further comprising a pressurized air passage running the longitudinal length of said cylindrical core and internally to said cylindrical core.

9. A spray head, comprising:

a tubular sleeve;

a plurality of nozzles arranged radially on a periphery of said tubular sleeve; and a core element disposed in said sleeve, said core element having radial partitions that divide the interior of said tubular sleeve in watertight fashion into a plurality of chambers, said nozzles communicating separately with said chambers, said core element having internal passages that feed water under pressure to said chambers, said spray head adapted to occupy an upright position, said passages emerging into a lower portion of said chambers when said spray head is in said upright position, thus allowing total purge of the chambers once the supply of water to said chambers has stopped.

10. A spray head, comprising:

a tubular sleeve,;

a plurality of nozzles arranged radially on a periphery of said tubular sleeve;

a core element disposed in said sleeve, said core element having radial partitions that divide the interior of said tubular sleeve in watertight fashion into a plurality of chambers, said nozzles communicating separately with said chambers, said core element having internal passages that feed water under pressure to said chambers;

at a distal end of said spray head, a cap having at least one spraying device operating as a nucleator; and means to supply pressurized water and air to said spraying device, said spraying device directing pressurized water and air into an area in which said nozzles discharge water.

11. The spray head as claimed in claim 10, wherein said nozzles are arranged in a row and discharge water in a common plane, and said spraying device discharges air and water under pressure in said plane.

12. The spray head as claimed in claim 10, wherein said nozzles are arranged in plural rows discharging water in divergent planes, and said spraying device discharges air and water under pressure between said divergent planes.

* * * * *